US011342171B2

(12) United States Patent
Hartungen

(10) Patent No.: US 11,342,171 B2
(45) Date of Patent: May 24, 2022

(54) METHOD FOR PRODUCING GASEOUS AMMONIUM FOR ION-MOLECULE-REACTION MASS SPECTROMETRY

(71) Applicant: IONICON ANALYTIK GESELLSCHAFT M.B.H., Innsbruck (AT)

(72) Inventor: Eugen Hartungen, Innsbruck (AT)

(73) Assignee: IONICON ANALYTIK GESELLSCHAFT. M.B.H., Innsbruck (AT)

( * ) Notice: Subject to any disclaimer, the term of this patent is extended or adjusted under 35 U.S.C. 154(b) by 0 days.

(21) Appl. No.: 16/761,673

(22) PCT Filed: Dec. 20, 2018

(86) PCT No.: PCT/EP2018/086332
§ 371 (c)(1),
(2) Date: May 5, 2020

(87) PCT Pub. No.: WO2019/122206
PCT Pub. Date: Jun. 27, 2019

(65) Prior Publication Data

US 2021/0183635 A1 Jun. 17, 2021

(30) Foreign Application Priority Data

Dec. 20, 2017 (EP) ..... 17209017

(51) Int. Cl.
*H01J 49/00* (2006.01)
*H01J 49/14* (2006.01)
*H01J 49/04* (2006.01)

(52) U.S. Cl.
CPC ..... *H01J 49/145* (2013.01); *H01J 49/0422* (2013.01)

(58) Field of Classification Search
CPC ..... H01J 49/145; H01J 49/0422
(Continued)

(56) References Cited

U.S. PATENT DOCUMENTS 7,009,175 B2 * 3/2006 Hansel ..... H01J 49/04 250/281
2009/0095901 A1 4/2009 Robinson
(Continued)

FOREIGN PATENT DOCUMENTS

| | | |
|---|---|---|
| DE | 19549144 | 7/1996 |
| DE | 102011009503 | 7/2012 |
| GB | 2324406 | 10/2001 |

OTHER PUBLICATIONS

International Search Report issued in PCT/EP2018/086332 dated Mar. 19, 2019.

(Continued)

*Primary Examiner* — Michael Maskell
(74) *Attorney, Agent, or Firm* — Workman Nydegger

(57) ABSTRACT

Method for obtaining gaseous ammonium ($NH_4^+$) from an ion source, the ion source comprising a first area (1) and a second area (2) in a fluidly conductive connection, comprising the steps of a) introducing $N_2$ and $H_2O$ into the first area (1) and second area (2) of the ion source; b) applying an ionization method to the mixture of $N_2$ and $H_2O$ in the first area (1); c) applying at least one electric field or adjusting pressure conditions or a combination of applying at least one electric field and adjusting pressure conditions promoting flow of ions from the first area (1) to the second area (2) and inducing reactions of the ions in the second area (2); d) conducting $NH_4^+$ out of the ion source. Ion Molecule Reaction-Mass Spectrometry instrument implementing this method for producing $NH_4^+$ and then conducting $NH_4^+$ to the reaction region.

19 Claims, 2 Drawing Sheets

(58) Field of Classification Search
USPC ..... 250/288, 493.1
See application file for complete search history.

(56) References Cited

U.S. PATENT DOCUMENTS

2013/0260473 A1 10/2013 Sulzer
2016/0013037 A1* 1/2016 Jorabchi ..... H01J 49/0031
73/23.37

OTHER PUBLICATIONS

W Lindinger et al., "Proton-transfer-reaction mass spectrometry (PTR-MS): on-line monitoring of volatile organic compounds at pptv levels", Chemical Society Reviews, Jan. 1, 1998 (Jan. 1, 1998), pp. 347-375.
Hansel A et al., "Proton transfer reaction mass spectrometry: on-line trace gas analysis at the ppb level", International Journal of Mass Spectrometry and Ion Processes, Elsevier Scientific Publishing Co., Amsterdam, NL, vo. 149-15, Nov. 15, 1995 (Nov. 15, 1995), pp. 609-619.
European Search Report issued in EP17209017 dated Jun. 18, 2018.
Written Opinion issued in PCT/EP2018/086332 dated Mar. 19, 2019.

* cited by examiner

METHOD FOR PRODUCING GASEOUS AMMONIUM FOR ION-MOLECULE-REACTION MASS SPECTROMETRY

The present invention relates to a method for obtaining gaseous ammonium ($NH_4^+$) from an ion source. The invention also relates to a method for ionizing a sample with gaseous ammonium, comprising obtaining ammonium and ionizing the sample in a reaction chamber. Furthermore, the invention relates to a method of detecting the ion yield of the mass-to-charge ratio of ions by detecting the ions in an MS-instrument. Finally, the invention relates to an IMR-MS instrument, comprising an ion source; a reaction region connected to said ion source; a mass spectrometer region connected to said reaction region; at least one inlet for source gases; at least one inlet for a sample into the reaction region; an $N_2$-source; a $H_2O$ source; and at least one pump.

BACKGROUND OF THE INVENTION

Gas analysis with Ion-Molecule-Reaction-Mass Spectrometry (IMR-MS) has been well established for many decades (see e.g. A. M. Ellis, C. A. Mayhew. Proton Transfer Reaction Mass Spectrometry Principles and Applications. John Wiley & Sons Ltd., UK, 2014). Among the most important techniques in this field are Proton-Transfer-Reaction-Mass Spectrometry (PTR-MS), Selected-Ion-Flow-Tube-Mass Spectrometry (SIFT-MS) and Selected-Ion-Flow-Drift-Tube-Mass Spectrometry (SIFDT-MS). In an ion source so-called primary or reagent ions are generated and injected into a reaction chamber (often called "drift tube" in PTR-MS, "flow tube" in SIFT-MS and "flow-drift tube" in SIFDT-MS), where chemical ionization of the analytes takes place. Typical chemical ionization reactions are:

Proton transfer reactions, either non-dissociative or dissociative, with A being the reagent ion (e.g. $H_2O.H^+$, $NH_3.H^+$, etc.) and BC being the analyte:

$$A.H^+ + BC \rightarrow A + BC.H^+$$

$$A.H^+ + BC \rightarrow A + B + C.H^+$$

Charge transfer reactions, either non-dissociative or dissociative, with A being the reagent ion (e.g. $O_2^+$, $NO^+$, $Kr^+$, etc.) and BC being the analyte:

$$A^+ + BC \rightarrow A + BC^+$$

$$A^+ + BC \rightarrow A + B + C^+$$

Clustering reactions, with A being the reagent ion (e.g. $H_3O^+$, $NO^+$, $O_2^+$, $NH_4^+$) and BC being the analyte:

$$A^+ + BC \rightarrow BC.A^+$$

In addition other types of reactions can occur (e.g. ligand switching, $H^+$ extraction in case of negatively charged reagent ions, etc.).

Eventually the reagent and product ions are separated by their mass-to-charge ratio m/z and detected in a mass spectrometer, amongst others, based on multipole, Time-Of-Flight (TOF) and ion trap technology. In addition, a series of common devices for controlling the various voltages, currents, temperatures, pressures, etc. need to be present in the instrument.

In PTR-MS traditionally $H_3O^+$ is used as reagent ions. However, recent PTR-MS instruments are additionally capable of utilizing alternative reagent ions, e.g. $NO^+$, $O_2^+$, $Kr^+$, $NH_4^+$ and any other positively or negatively charged reagent ions and thus are sometimes called Selective-Reagent-Ionization-Mass Spectrometry (SRI-MS) instruments. Also in SIFT-MS and SIFDT-MS a variety of reagent ions can be used, with $H_3O^+$, $NO^+$ and $O_2^+$ being the most common ones.

All of these reagent ions used in IMR-MS have distinct advantages, which make them particularly suitable for certain applications. A particular beneficial reagent ion is the ammonium cation $NH_4^+$. $NH_3$ has a Proton Affinity (PA) of 854 kJ/mol, whereas $H_2O$ has a PA of 691 kJ/mol. Proton transfer is energetically only possible if the PA of the analyte is higher than the PA of the reagent ion. Thus, some of the advantages of using $NH_4^+$ are:

Improved selectivity: In IMR-MS often two or more compounds are detected at the same nominal m/z (e.g. isobars or isomers). If they share the same exact m/z (isomers) or if the mass resolution of the mass spectrometer is insufficient to separate isobars, additional measures have to be taken to distinguish them. Pinene ($C_{10}H_{16}$; PA<854 kJ/mol and >691 kJ/mol) and 2-ethyl-3,5-dimethylpyrazine ($C_8H_{12}N_2$; PA>854 kJ/mol) are mentioned as examples in the prior art. The protonated molecules of both compounds share nominal m/z 137 when using $H_3O^+$ as reagent ions. However, with $NH_4^+$ as reagent ions, only 2-ethyl-3,5-dimethylpyrazine gets protonated whereas pinene does not react. That is, if only one of these two compounds is present in a sample and ions are detected at m/z 137 with $NH_4^+$ as reagent ions, the compound can be identified as 2-ethyl-3,5-dimethylpyrazine. If ions are detected at m/z 137 with $H_3O^+$ as reagent ions, but not with $NH_4^+$, the compound can be identified as pinene.

Simplification of mass spectra: If, for example, in a complex sample only compounds with a PA higher than the PA of $NH_3$ need to be detected and quantified, using $NH_4^+$ reagent ions will blank out all analytes with a PA lower than the PA of $NH_3$ and thus will lead to a mass spectrum which is considerably easier to interpret than a mass spectrum generated with $H_3O^+$ reagent ions.

Less fragmentation: Compounds with high PAs (>854 kJ/mol) often show high levels of fragmentation upon PTR ionization from $H_3O^+$, which makes identification and quantification difficult. The explosive TATP ($C_9H_{18}O_6$) does not form the characteristic ion TATP.$H^+$ (or only with a very low abundance), but many fragment ions when reacting with $H_3O^+$ at a reduced electric field strength (E/N) which is typically used in PTR-MS. When switching to $NH_4^+$ as reagent ions the protonated TATP molecule as well as TATP.$NH_4^+$ are formed with high abundance and thus detection and identification of this explosive is improved. Another example is the Chemical Warfare Agent (CWA) sarin ($C_4H_{10}FO_2P$), which also shows a high level of fragmentation upon $H_3O^+$ ionization. Using $NH_4^+$ as reagent ions effectively suppresses fragmentation and produces the protonated sarin molecule as well as [sarin+$NH_3$].$H^+$ clusters.

GB 2 324 406 B describes a method of generating $NH_4^+$ reagent ions with high purity, so that they can be used without further filtering in a PTR-MS device. In this method $NH_3$ is introduced into the first ionization chamber of the ion source. The ionization products are subsequently left in the second ionization chamber of the ion source, together with $NH_3$, until the ionization products which are initially other than $NH_4^+$ are converted into $NH_4^+$ ions. This is a method similar to the method described in DE 195 49 144, which is used to generate $H_3O^+$ from $H_2O$ vapor, but with the source gas being $NH_3$ instead of $H_2O$.

In SIFT-MS $NH_4^+$ reagent ions are generated in a similar way, namely by ionization of $NH_3$ in the ion source and subsequent ion-molecule reactions between $NH_3^+$ and $NH_3$, which form $NH_4^+$ (and $NH_2$).

In AT 413 463 B an extended ion source for PTR-MS is used, which is equipped with an additional ionization chamber. In order to generate $NH_4^+$ the ion source is operated in a way such that in the second ionization chamber $H_3^+$ is produced and introduced together with $NH_3$ into a third ionization chamber, where $H_3^+$ and $NH_3$ react to $NH_4^+$ (and $H_2$).

A different method of generating $NH_4^+$ reagent ions in a PTR-MS instrument is described in DE 10 2011 009 503 A1. There, the PTR-MS instrument is operated so that the ion source produces $H_3O^+$ reagent ions from $H_2O$ source gas, i.e. in the most common way a PTR-MS instrument is being operated. However, $NH_3$ is introduced into the drift tube via the sample inlet at a sufficiently high concentration, so that the majority of the $H_3O^+$ reacts with $NH_3$ to $NH_4^+$ (and $H_2O$). In other words, $H_3O^+$ reagent ions are converted to $NH_4^+$ reagent ions in the drift tube by the introduction of $NH_3$.

In summary, all methods for generating $NH_4^+$ in an IMR-MS instrument require the introduction of $NH_3$ into at least one part on the instrument. However, there are a number of considerable disadvantages when using $NH_3$ in an IMR-MS instrument:

- $NH_3$ is toxic, corrosive and environmentally hazardous.
- The use of $NH_3$ gas cylinders requires a high level of safety precautions and is prohibited in some areas.
- The use of ammonia solutions as an $NH_3$ source does not provide a stable $NH_3$ concentration over time.
- $NH_3$ can damage important parts of the instrument, such as lines, lenses, vacuum pumps, valves, flow controllers, etc.
- The exhaust of the IMR-MS instrument is contaminated with $NH_3$ and needs to be properly disposed.
- The surfaces inside the IMR-MS instrument get covered with $NH_3$ which desorbs very slowly after switching to a different reagent ion, i.e. switching from $NH_4^+$ to $H_3O^+$ takes tens of minutes if not hours.

SHORT DESCRIPTION OF THE INVENTION

Due to the large number of disadvantages associated with the generation of $NH_4^+$, this ion is rarely used in IMR-MS devices as reagent ion. $H_3O^+$ is still the standard reagent ion despite its disadvantages such as lower selectivity, more complex mass spectra and higher levels of fragmentation.

The object of the present invention is to provide an ion source with higher selectivity, simpler spectra and less fragmentation when compared to $H_3O^+$ but with less disadvantages than the known methods involving $NH_3$ in the generation of $NH_4^+$.

The problem is solved by a method for obtaining gaseous ammonium ($NH_4^+$) from an ion source, the ion source comprising a first area and a second area in a fluidly conductive connection, comprising the steps (a) introducing $N_2$ and $H_2O$ into the first and second area of the ion source;

(b) applying an ionization method to the mixture of $N_2$ and $H_2O$ in the first area;

(c) applying at least one electric field or adjusting pressure conditions or a combination of applying at least one electric field and adjusting pressure conditions promoting flow of ions from the first area to the second area and inducing reactions of the ions in the second area, (d) conducting $NH_4^+$ out of the ion source.

Surprisingly it has been found that by applying an ionization method to a mixture of $N_2$ and $H_2O$ in the first area of the ion source and then applying at least one field or adjusting pressure conditions or a combination of applying at least one field and adjusting pressure conditions thereby promoting flow of ions from the first area to the second and thereby also inducing collisions and thus reactions of the ions and neutral $H_2O$ and $N_2$ in the second area, resulted a high yield of $NH_4^+$ with almost no other ions, in particular no parasitic ions, in the second area. Absolutely no $NH_3$ needs to be added to this process at any stage, which is in stark contrast to the prior art, and therefore the negative side effects caused by the use of this dangerous, toxic and corrosive source gas in previous designs are diminished.

The at least one field is an electric field. The pressure and/or the electric field are such as to promote flow of ions resulting from the ionization process in the first area to the second area. Neutral $N_2$ and $H_2O$ are introduced into the second area either by a flow of remaining neutrals from the first area or by injection into the second area (depending on the type and design of the ionization in the first area). Furthermore, the field and/or pressure are such to induce collisions in the second area and thus to promote $NH_4^+$ formation. Furthermore, a magnetic field may be applied.

In one embodiment, step (c) includes maintaining the pressure in the second ionization chamber at a pressure below the pressure of the first ionization chamber and applying an electric field in the second ionization chamber to support flow of ions and remaining neutrals from the first ionization chamber to the second ionisation chamber, leading to $NH_4^+$ formation via ion-molecule reactions in the second ionization chamber.

In one embodiment there is at least one source gas inlet for introducing $N_2$ and $H_2O$ into the first area.

It turned out that the molar mixing ratio of $N_2$ and $H_2O$ may be varied over a broad range to allow formation of $NH_4^+$. Useful molar mixing ratios of $N_2$ to $H_2O$ in the first ionization chamber are between 1:9 and 9:1. In a preferred embodiment the molar mixing ratios are between 3:7 and 7:3. Most preferably, the molar ratio between $N_2$ and $H_2O$ is approximately 1:1.

Though, the $N_2$ source may be any gaseous source of $N_2$ such as air, in a preferred embodiment the $N_2$ source is essentially pure gaseous $N_2$.

In one embodiment $N_2$ and $H_2O$ are mixed before the introduction into the first ionization chamber.

Alternatively, $N_2$ and $H_2O$ are introduced into the first area separately and are mixed directly in first area.

In one embodiment $N_2$ and/or $H_2O$ are introduced in the second area and $N_2$ and/or $H_2O$ flow to the first area from the second area.

In one embodiment $N_2$ and $H_2O$ are introduced into the first and the second area.

While the two areas of the ion source may be in a single vessel, there is a preferred embodiment, where the first area is a first ionization chamber and the second area is a second ionization chamber, first and second ionization chamber being connected to allow fluid exchange. The spatial separation of first and second area allows flow control of ions and/or neutrals from the first ionization chamber to the second ionization chamber more easily. Furthermore, the spatial separation allows for simple adjustment of the pressure in the second area without affecting the pressure in the first area. Hence, first area and second area are then first ionization chamber and second ionization chamber, respectively. The ionization source is preferably in the first area/ ionization chamber. The source for the (electric) field is preferably in the second area/ionization chamber.

The invention further relates to a method for ionizing a sample with gaseous ammonium, comprising obtaining gaseous ammonium according to the method described above and ionizing the sample in a reaction chamber being connected with the exit of the second ionization chamber.

Furthermore the invention relates to a method of detecting the ion yield of the mass-to-charge ratio of ions produced by the method of the previous paragraph, by detecting the ions in an MS-instrument.

Finally, the inventions relates to an IMR-MS instrument, comprising

- an ion source comprising a first area and a second area, an ionization source and at least one source for a electric field;
- a reaction region connected to said ion source;
- a mass spectrometer region connected to said reaction region;
- at least one inlet for source gases;
- at least one inlet for a sample into the reaction region;
- an $N_2$-source;
- a $H_2O$ source;
- at least one pump; and
- a controlling device controlling
  - flow of $N_2$ of the $N_2$-source,
  - flow of $H_2O$ of the $H_2O$-source.
  - the least one pump,
  - ionization source and
  - the source for the electric field
- so as to produce gaseous ammonium ($NH_4^+$) in said second area and then conducting the $NH_4^+$ to the reaction region.

Preferably, the first area and the second area are a first ionization chamber and a second ionization chamber, wherein said second ionization chamber is connected to said first ionization chamber, wherein the first ionization chamber includes the ionization source and the second ionization chamber includes the at least one source for the field.

It is preferred that the controlling device also controls the pressure in the second area.

Additionally, a source for a magnetic field may be present.

DETAILED DESCRIPTION OF THE INVENTION

FIG. 1 is a schematic view of a typical IMR-MS instrument, comprising a first ionization chamber 1, a second ionization chamber 2, a reaction region 3 (e.g. drift, flow or flow-drift tube in PTR-, SIFT- and SIFDT-MS, respectively), a mass spectrometer region 4 (e.g. TOF, multipole, ion trap, MS″, etc.), one or more inlet(s) 5 for source gases, one or more inlet(s) 6 for sample and, if needed, carrier or buffer gas, region 7 between 2 and 3.

Figure 1:
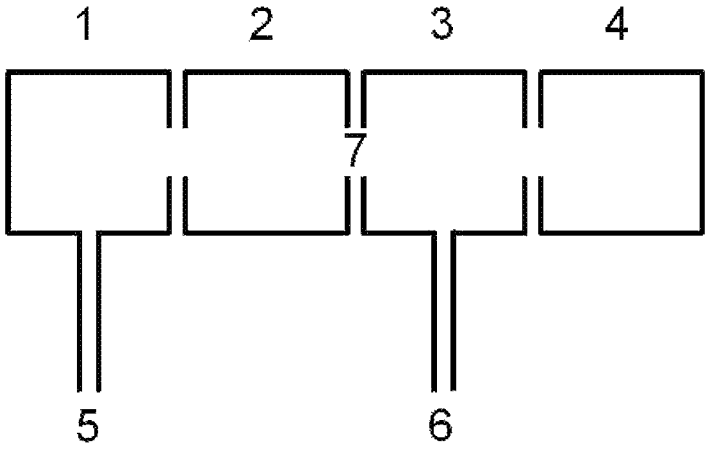
Figure 2:
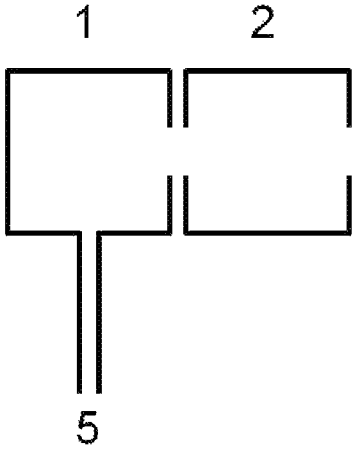
FIG. 2 shows a schematic view of the parts needed for the present invention: first ionization chamber 1, second ionization chamber 2, one or more inlet(s) 5 for source gases.

The present invention solves all of the above-mentioned problems associated with the use of $NH_3$ source gas and enables the generation of $NH_4^+$ reagent ions at high purity levels without the introduction of $NH_3$, so that the $NH_4^+$ can directly be used in IMR-MS instruments, which are not equipped with a filter for reagent ions, e.g. PTR-MS instruments. The invention can also be used in IMR-MS instruments, which are equipped with a filter for reagent ions, e.g. multipole mass filters in SIFT-MS or SIFDT-MS instruments. The invention does neither require any form of $NH_3$ nor any other toxic, harmful, environmentally hazardous or corrosive chemicals. The minimum required parts of an IMR-MS instrument necessary for the realization of the invention are schematically shown in FIG. 2.

$NH_4^+$ reagent ions are generated by introducing $N_2$ and $H_2O$ via a source gas inlet 5 into the first ionization chamber (FIC) 1 of an ion source, where $N_2$ and $H_2O$ are ionized e.g. in a hollow cathode discharge, corona discharge, point discharge, plane electrode discharge, microwave discharge, radioactive ionization, electron ionization involving a filament, or via any other ionization method. The ionization products as well as (remaining) neutral $N_2$ and $H_2O$ are introduced into a second ionization chamber (SIC) 2, which can either be spatially separated and connected via an aperture or form a part of the FIC 1. The pressure (and possibly also the electric fields) in the SIC 2 are adjusted so that via ion-molecule reactions the partly ionized species react to $NH_4^+$ and only minor parasitic ions are left (e.g. below 10% and preferably below 5%). The pressure in the SIC 2 can e.g. be adjusted via a pump ring, which can be installed in or adjacent to the SIC 2 and connected to a pump via a valve or a pressure limiting aperture or via any other pressure adjusting mechanism applied to the SIC 2. The electric fields can be adjusted by adjusting the voltages and currents applied to different parts of the ion source.

In order to achieve $NH_4^+$ in purity levels of higher than 90% and preferably higher than 95% (in relation to parasitic ions) primarily the ratio between the source gas flows into the FIC 1, i.e. $N_2$ and $H_2O$, and the pressure in the SIC 2 have to be optimized. The actual values depend strongly on the ion source used. The $N_2$:$H_2O$ flow ratio typically is between 1:9 and 9:1, preferably between 3:7 and 7:3 and in some embodiments at about 1:1. The source of $N_2$ can be any $N_2$ source, preferably from an $N_2$ gas cylinder or an $N_2$ gas lab supply line. Using air as an $N_2$ source is also possible, as air largely consists of $N_2$. The purity of the generated $NH_4^+$ is, however, negatively affected by the use of air, i.e. more parasitic ions are generated. This can be acceptable in case no pure $N_2$ is available or a reagent ion filtering device is used (e.g. in SIFT-MS, SIFDT-MS). The source of $H_2O$ can be water vapor, preferably from the headspace of a water reservoir, which is evacuated by the suction created by the vacuum in the ion source. The flow rates of $N_2$ and $H_2O$ can be controlled e.g. by mass flow controllers, valves, pressure limiting apertures, lines with suitable inner diameters, etc.

In one embodiment $N_2$ and $H_2O$ are mixed prior to the source gas inlet 5 and introduced as a mixture. In another embodiment an additional source gas inlet is installed and $N_2$ and $H_2O$ are introduced separately into the FIC 1. In another embodiment $H_2O$ is introduced into the FIC 1 and $N_2$ is introduced via an additionally installed source gas inlet into the SIC 2, so that it expands into the FIC 1 and $N_2$ and $H_2O$ are present in the FIC 1 and SIC 2. In another embodiment $N_2$ is introduced into the FIC 1 and $H_2O$ is introduced via an additionally installed source gas inlet into the SIC 2, so that it expands into the FIC 1 and $N_2$ and $H_2O$ are present in the FIC 1 and SIC 2. In another embodiment $N_2$ and $H_2O$ are introduced via additionally installed source gas inlets into the SIC 2, so that the gases expand into the FIC 1 and $N_2$ and $H_2O$ are present in the FIC 1 and SIC 2. Any other means of introducing $N_2$ and $H_2O$ into the FIC 1 and SIC 2 are also possible. This includes, but is not limited to, backflow of $N_2$ and/or $H_2O$ from any part of the instrument into FIC 1 and SIC 2, e.g. from the drift tube in case of a PTR-MS instrument.

The pressure in the SIC 2 should be at least at 0.01 hPa, should be below 100 hPa and has to be adjusted so that $NH_4^+$ is efficiently generated. Further improvement of effective $NH_4^+$ generation and suppression of parasitic ions can be achieved by applying electric fields, which accelerate ions in the FIC 1 and the SIC 2, respectively, from the FIC 1 into the SIC 2 and/or extract ions from the ion source.

Switching between $NH_4^+$ generation and any other reagent ion can be done by switching the source gases, adjusting the source gas flows, adjusting the pressure in the SIC 2 and adjusting the electric fields. In particular, switching from $NH_4^+$ to $H_3O^+$ can be done by shutting off the $N_2$ flow, adjusting the $H_2O$ flow, adjusting the pressure in the SIC 2 and adjusting the electric fields. Switching from $H_3O^+$ (which is generated from $H_2O$) to $NH_4^+$ can be done by adding $N_2$ to the ion source, adjusting the $H_2O$ and $N_2$ flows, adjusting the pressure in the SIC 2 and adjusting the electric fields.

In the following example we applied the invention to a commercially available IMR-MS instrument, namely a PTR-TOF 1000 from IONICON Analytik GmbH., Austria. The example should by no means limit the applicability of the invention to a specific instrument or specific settings. For this particular instrument the FIC 1 is a hollow cathode ion source, the SIC 2 is a source drift region, the reaction region 3 is a drift tube consisting of a series of electrically isolated stainless steel rings with an applied voltage gradient and the mass spectrometer region 4 is a TOF mass spectrometer.

The source gas inlet 5 is connected to two source gas lines, with a mass flow controller installed in each line. The headspace above purified water and $N_2$ from a gas cylinder (99.999% purity) is connected to the lines, respectively. Sample inlet 6 is fed with purified air. At the intermediate position 7 between the SIC 2 and the reaction region 3 a pump ring is installed, which is connected to a split-flow turbo-molecular pump via an electronically controllable proportional valve. Thus the pressure in the SIC 2 can be adjusted by adjusting this so-called source valve, where 0% means the valve is fully closed, i.e. no pumping power is applied, and 100% means the valve is fully opened, i.e. maximum pumping power is applied. As this is a PTR-MS instrument, no filtering device is installed between the ion source and the reaction region and therefore, if purified air is introduced to the sample inlet, i.e. negligible impurities are introduced into the reaction region, the purity of the reagent ions can be directly measured with the mass spectrometer 4. For the measurements a drift tube pressure of 2.3 hPa and a drift tube temperature of 60° C. were selected. The hollow cathode ion source 1 was operated at a discharge current of 3.5 mA.

Figure 3:
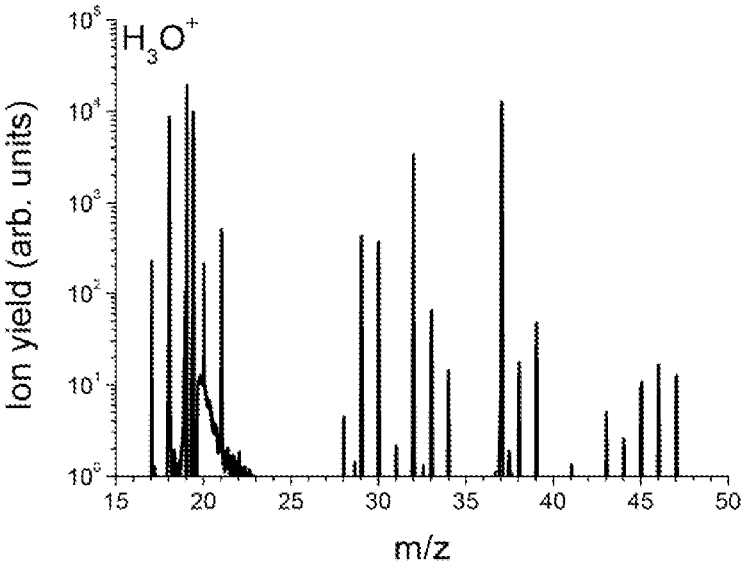
FIG. 3 shows a part of a mass spectrum obtained with the instrument running in $H_3O^+$ mode.

FIG. 3 shows a part of the mass spectrum with a mass-to-charge ratio m/z between 15 and 50, i.e. the region where impurities from the ion source are expected. The ion source is operated with the established $H_3O^+$ reagent ions. The $H_2O$ source gas is set to 6.5 sccm ($cm^3$ per min at standard conditions), no $N_2$ source gas is added. The source valve is set to 54%. The voltage, which is applied to extract ions from the FIC 1 to the source drift region 2 is set to 130 V. It has to be noted that the detector gets overloaded by the high ion yield at m/z 19, which corresponds to $H_3O^+$. Therefore, the ion yield at m/z 21, which corresponds to a naturally occurring isotope of $H_3O^+$ has to be multiplied by a factor of 500 in order to get the number of reagent ions. With these ion source settings and a drift tube voltage of 600 V applied, a $H_3O^+$ reagent ion yield of about $22\times10^6$ cps (ion counts per second) is achieved. The relative amount of parasitic ions are about 4.6% plus about 2.4% water cluster $2(H_2O).H^+$ at m/z 37, which is dependent on the drift tube voltage.

Figure 4:
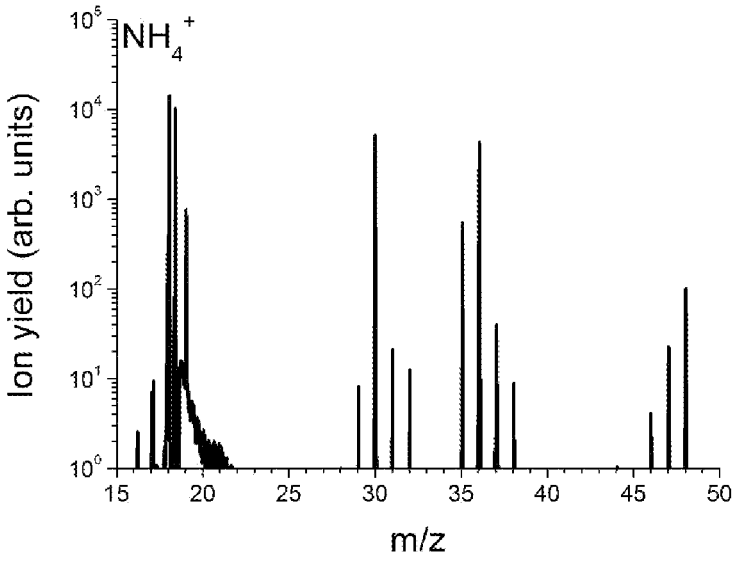
FIG. 4 shows a part of a mass spectrum obtained with the instrument running in $NH_4^+$ mode, i.e. in the mode according to the invention.

FIG. 4 shows a part of the mass spectrum with a mass-to-charge ratio m/z between 15 and 50 after the invention has been applied. The switching time takes about 3-5 s and is mainly limited by the response time of the mass flow controllers controlling the source gas flows. The $H_2O$ flow is set to 3 sccm and the $N_2$ flow is set to 3 sccm, i.e. the ratio between $H_2O$ and $N_2$ is 1:1. The source valve is set to 45%, i.e. lower than for $H_3O^+$ generation, which means that the pressure in the source drift region 2 is increased. The voltage, which is applied to extract ions from the FIC 1 to the source drift region 2 is set to 250 V, i.e. higher than for $H_3O^+$ generation. It has to be noted that the detector gets overloaded by the high ion yield at m/z 18, which corresponds to $NH_4^+$. Therefore the ion yield at m/z 19, which corresponds to a naturally occurring isotope of $NH_4^+$ and can be separated from the parasitic $H_3O^+$ sharing the same nominal m/z, because of the high mass resolution of the utilized TOF mass spectrometer 4, has to be multiplied by a factor of 250 in order to get the number of $NH_4^+$ reagent ions.

With these ion source settings and a drift tube 3 voltage of 650 V applied, a $NH_4^+$ reagent ion yield of about $19\times10^6$ cps, i.e. a comparable intensity to the $H_3O^+$ mode, is achieved. The relative amounts of parasitic ions are about 2.4%, i.e. the reagent ions are even more pure than in $H_3O^+$ mode, plus about 0.1% $2(NH_3).H^+$ at m/z 35, which is dependent on the drift tube voltage.

With this particular instrumental setup we could achieve $NH_4^+$ ion yields with high purity and high abundance at pressures in the source drift region 2 between about 2-4 hPa and electric field strengths in the source drift region 2 of 350-800 $V/cm^2$. These pressure and field strength regions will vary considerably depending on the geometry and the type of the ion source.

Switching back to $H_3O^+$ by applying the above-mentioned settings for $H_3O^+$ mode again just takes seconds and the relative amount of remaining parasitic $NH_4^+$ drops below 10% nearly instantaneously and below 4% after some tens of seconds.

In cases where extremely high purity of $NH_4^+$ is needed and even minor amounts of parasitic $H_3O^+$ and $2(H_2O).H^+$ ions need to be avoided, a compound with a PA, which is higher than the PA of $2(H_2O)$ (808 kJ/mol; thus also higher than the PA of $H_2O$), but lower than the PA of $NH_3$ (i.e. PA between 808 and 854 kJ/mol) can be added in sufficient concentration to the reaction region 3, e.g. via the sample inlet 6. This will cause the parasitic $H_3O^+$ and $2(H_2O).H^+$ to react with this compound, leading to depletion of the parasitic water and water cluster ions.

In summary the invention enables the powerful capability of operating an IMR-MS instrument with $NH_4^+$ reagent ions. No $NH_3$ or any other harmful, toxic, environmentally hazardous, corrosive, etc. compounds are necessary for $NH_4^+$ production. The only compounds needed are $N_2$ and $H_2O$. These compounds are injected into the ionization region of a FIC 1 and subsequently left in a SIC 2 until the partially ionized products predominantly react to $NH_4^+$. In our example we used a PTR-MS ion source, originally designed for being operated with $H_3O^+$ reagent ions, introduced $N_2$ and $H_2O$ with a ratio of 1:1 into the ionization region 1 and increased the pressure in the source drift region 2 (compared to the pressure used for $H_3O^+$ generation) in order to get $NH_4^+$ reagent ions with a purity of more than 97%. Additionally, we increased the voltage extracting ions from the FIC 1 into the SIC 2 compared to the voltage used for $H_3O^+$ generation. Switching between reagent ions could be achieved within seconds. The invention is by no means limited to this example, but works with any IMR-MS ion source.

The invention claimed is:

1. A method for ionizing a sample with gaseous ammonium in an Ion-Molecule-Reaction-Mass Spectrometry instrument, comprising:

(i) obtaining gaseous ammonium ($NH_4^+$) from an ion source, the ion source comprising a first area and a second area in a fluidly conductive connection, comprising the steps of:

(a1) introducing a controlled flow of $N_2$ into the first area or second area of the ion source;

(a2) introducing a controlled flow of $H_2O$ into the first area or second area of the ion source;

(b) applying an ionization method to the mixture of $N_2$ and $H_2O$ in the first area;

(c) applying at least one electric field or adjusting pressure conditions or a combination of applying at least one electric field and adjusting pressure conditions promoting flow of ions from the first area to the second area and inducing reactions of the ions in the second area;

(d) conducting $NH_4^+$ out of the ion source into a reaction chamber connected with the ion source;

(e) introducing the sample into the reaction chamber; and (ii) ionizing the sample in the reaction chamber.

2. The method according to claim 1, wherein the first area is a first ionization chamber and the second area is a second ionization chamber being connected to allow fluid exchange.

3. The method according to claim 2, wherein the ionization source for applying the ionization method is in the first ionization chamber and/or the source for the electric field is in the second ionization chamber.

4. The method according to claim 1, further comprising applying a magnetic field.

5. The method according to claim 1, wherein the $N_2$ source is essentially pure gaseous $N_2$.

6. The method according to claim 1, wherein $N_2$ and $H_2O$ are mixed prior to the introduction into the ion source.

7. The method according to claim 1, wherein $N_2$ and $H_2O$ are introduced into the ion source separately and are mixed directly in the ion source.

8. The method according to claim 1, wherein $N_2$ and/or $H_2O$ are introduced in the second area and $N_2$ and/or $H_2O$ flow into the first area from the second ionization chamber.

9. A method of detecting the ion yield of the mass-to-charge ratio of ions produced according to claim 1, by detecting the ions in Mass Spectrometry instrument.

10. An Ion-Molecule-Reaction Mass Spectrometry (IMR-MS) instrument, comprising an ion source with a first area and a second area, an ionization source and at least one source for an electric field;

a reaction region connected to said ion source;

a mass spectrometer region connected to said reaction region;

at least one inlet for source gases;

at least one inlet for a sample into the reaction region;

an $N_2$-source;

a $H_2O$ source;

at least one pump; further comprising:

a controlling device controlling flow of $N_2$ of the $N_2$-source, flow of $H_2O$ of the $H_2O$-source, the least one pump, the ionization source, and the source for the electric field, so as to produce gaseous ammonium ($NH_4^+$) in said second area and then to conduct $NH_4^+$ to the reaction region via an exit to contact and ionize the sample introduced into the reaction region.

11. The IMR-MS instrument according to claim 10, wherein the controlling device also controls the pressure in the second area.

12. The IMR-MS instrument according to claim 10, wherein the first area and the second area are a first ionization chamber and a second ionization chamber, wherein said second ionization chamber is connected to said first ionization chamber, wherein the first ionization chamber includes the ionization source and the second ionization chamber includes the at least one source for the electric field.

13. The IMR-MS instrument according to claim 10, further comprising an additional source for a magnetic field.

14. The method according to claim 2, wherein the mixing ratio of $N_2$ to $H_2O$ in the first ionization chamber is between 3:7 and 7:3.

15. The method according to claim 2, wherein the mixing ratio of $N_2$ to $H_2O$ in the first ionization chamber is approximately 1:1.

16. The IMR-MS instrument according to claim 10, wherein the controlling device is configured to cause a mixing ratio of $N_2$ to $H_2O$ in the first area is between 1:9 and 9:1.

17. A method for ionizing a sample with gaseous ammonium, comprising:

(i) obtaining gaseous ammonium ($NH_4^+$) from an ion source, the ion source comprising a first area and a second area in a fluidly conductive connection, comprising the steps of:

(a1) introducing a controlled flow of $N_2$ into the first area or second area of the ion source;

(a2) introducing a controlled flow of $H_2O$ into the first area or second area of the ion source;

(b) applying an ionization method to the mixture of $N_2$ and $H_2O$ in the first area;

(c) applying at least one electric field or adjusting pressure conditions or a combination of applying at least one electric field and adjusting pressure conditions promoting flow of ions from the first area to the second area and inducing reactions of the ions in the second area; and (d) conducting $NH_4^+$ out of the ion source; and (ii) ionizing the sample in a reaction chamber being connected with the ion source, wherein the mixing ratio of $N_2$ to $H_2O$ in the first area is between 1:9 and 9:1.

18. The method according to claim 17, wherein the first area is a first ionization chamber and the second area is a second ionization chamber being connected to allow fluid exchange.

19. An Ion-Molecule-Reaction-Mass Spectrometry (IMR-MS) instrument, comprising an ion source with a first area and a second area, an ionization source and at least one source for an electric field, wherein the first area is a first ionization chamber and the second area is a second ionization chamber being connected to allow fluid exchange;

a reaction region connected to said ion source;

a mass spectrometer region connected to said reaction region;

at least one inlet for source gases;

at least one inlet for a sample into the reaction region;

an $N_2$-source;

a $H_2O$ source;

at least one pump; further comprising:

a controlling device controlling flow of $N_2$ of the $N_2$-source, flow of $H_2O$ of the $H_2O$-source, the least one pump, ionization source, and the source for the electric field, so as to produce gaseous ammonium ($NH_4^+$) in said second area and then conducting $NH_4^+$ to the reaction region via an exit, wherein the controlling device is configured to cause a mixing ratio of $N_2$ to $H_2O$ in the first ionization chamber is between 1:9 and 9:1.

* * * * *